United States Patent [19]

Moroo et al.

[11] Patent Number: 4,600,313

[45] Date of Patent: Jul. 15, 1986

[54] KNEADING MACHINE

[75] Inventors: Akira Moroo, Tokyo; Yoshiyasu Tokunaga, Hatano; Takashi Suzuki, Isehara; Tadahiko Yoshioka, Kawasaki, all of Japan

[73] Assignee: Inoue Seisakusho (Mfg.) Co., Ltd., Isehara, Japan

[21] Appl. No.: 675,968

[22] Filed: Nov. 28, 1984

[30] Foreign Application Priority Data

Mar. 23, 1984 [JP] Japan ..... 59-54523

[51] Int. Cl.[4] ..... B01F 7/04

[52] U.S. Cl. ..... 366/313; 366/325

[58] Field of Search ..... 366/97, 99, 279, 312, 366/313, 325, 328

[56] References Cited

U.S. PATENT DOCUMENTS 2,526,367 10/1950 Kaltenbach et al. ..... 366/313 X
3,145,017 8/1964 Thomas ..... 366/313 X
3,182,633 5/1965 Lodige et al. ..... 366/99 X

FOREIGN PATENT DOCUMENTS 793457 4/1958 United Kingdom ..... 366/312

*Primary Examiner*—Philip R. Coe
*Attorney, Agent, or Firm*—Howson and Howson

[57] ABSTRACT

A kneading machine comprises a cylindrical container with a supply opening and a discharge opening, a rotational shaft disposed on the axis of the container, and a plurality of blades on the shaft. Each blade comprises a pair of side plates and a kneading blade. The kneading blade is formed with a roll-in angle, and in the case of a batch-type kneading machine, both side plates are disposed at a feed angle to effect axially reciprocating movement of material for more efficient kneading. In the case of a continuous process kneading machine, the supply and discharge are axially displaced, and some of the blades comprise side plates perpendicular to the rotation axis, while other blades have an angled side plate for effecting gradual axial feed of material from supply to discharge. The blades are replaceable on the shaft. The rate of feed, and therefore the speed at which kneading takes place, can be adjusted by selecting appropriate numbers and positions for the blades with angled side plates.

7 Claims, 10 Drawing Figures

KNEADING MACHINE

BRIEF SUMMARY OF THE INVENTION

The present invention relates to an apparatus for kneading a material such as pigment within a laterally installed cylindrical container.

In a conventional kneading machine, as shown in FIG. 1, a material to be treated is thrown batchwise into a kneading container V. Two rotational driving shafts S1 and S2 are mounted within the container V and radial blades B1 and B2 are mounted on shafts S1 and S2, respectively. Each of blades B1 and B2 has a pair of side plates and a kneading blade mounted between ends of said side plates. N1 is the kneading blade of blade B1 and N2 is the kneading blade of blade B2. The kneading container V has two circularly formed bottom portions and the material to be treated is kneaded between the circular bottom portions and end edges of the kneading blades N1 and N2. In the above-described conventional apparatus, kneading takes place over kneading areas A1 and A2, each of which subtends substantially less than one-half of a complete rotation of its corresponding blade. Therefore, the kneading efficiency is very limited. The kneading areas A1 and A2 can, of course, be increased, but this inevitably requires an enlargement of the kneading container. Moreover, in the upper half portions of the rotation of the kneading blades, they are not close enough to inner walls of the container, and therefore, it is not possible to feed the material to be treated in a given direction and the kneading function is always effected at the same place. Thus, with the conventional kneading machine, batch type kneading work is possible, but continuous work is difficult.

In order to remove the disadvantages noted above with respect to prior art, in the present invention, the container is formed into a cylindrical shape so that the kneading blades may perform the kneading function over substantially the whole circumference of the container. A roll-in angle is formed at the end of each kneading blade to render inverted kneading of a material to be treated possible. Preferably, at least one of the pair of side plates of the blade is formed with a feed angle to effect feeding of the material to be treated in an axial direction. Axial feeding is useful in a batch-type machine in accordance with the invention, and is also useful in a continuous-type machine for effecting gradual movement of the material to be treated from a supply opening of the kneading machine to a discharge opening.

The present invention, therefore has as its objects, the enhancement of kneading efficiency, the avoidance of the several disadvantages of conventional kneading machines, and also the provision of a highly efficient continuously operating kneading machine. These and other objects and advantages of the invention will be apparent from the following detailed description.

DETAILED DESCRIPTION

Figure 2:
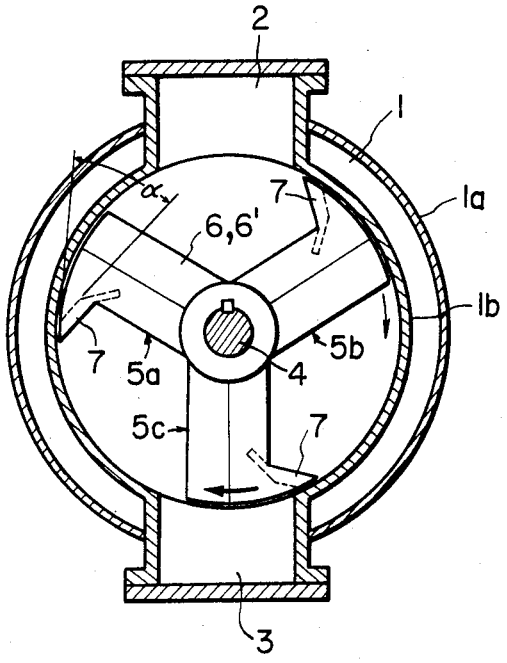
FIG. 2 is a radial section of a batch-type kneading machine in accordance with the invention.
Figure 3:
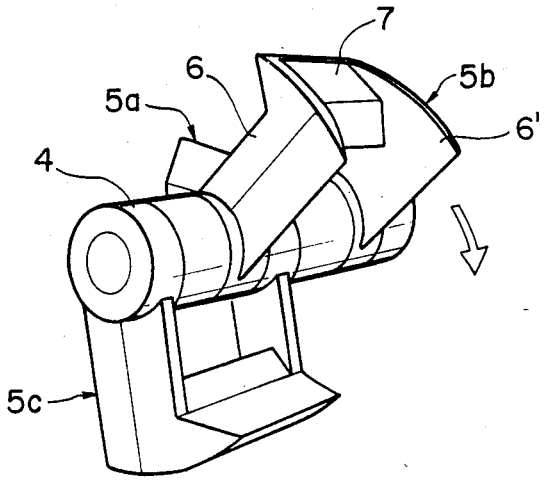
FIG. 3 is a perspective view of the blades of the kneading machine of FIG. 2.
Figure 4:
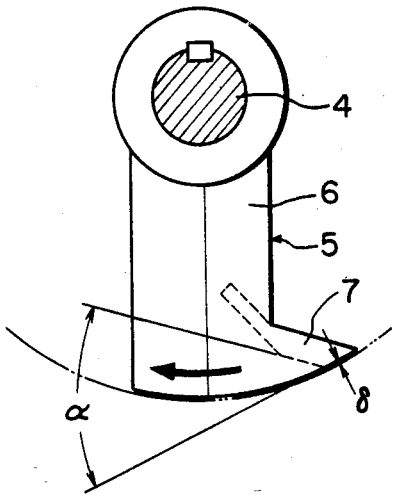
FIG. 4 is an enlarged view, in radial section, of a kneading blade of the batch-type kneading machine.
Figure 5:
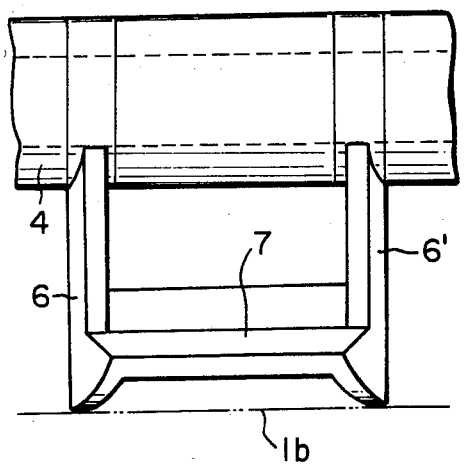
FIG. 5 is a front elevation of the kneading blade, as viewed from the right side of FIG. 4.
Figure 6:
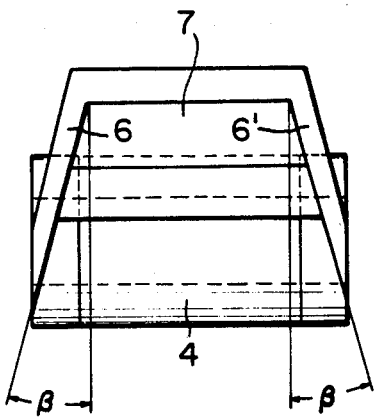
FIG. 6 is a bottom plan view of the blade of FIG. 4.

FIGS. 2 and 3 show a batch-type kneading apparatus in accordance with a first embodiment of the invention. A cylindrical container 1 composed of an outer cylinder 1*a* and an inner cylinder 1*b* is provided at its upper portion with a supply opening 2 for a material to be treated and at its lower portion with a discharge opening 3. The central axis of the cylindrical container extends laterally with respect to the direction of flow of material through the supply and discharge openings. Therefore, the kneading machine can be said to be "laterally installed" with respect to the general direction of material flow through the machine. A rotational driving shaft 4 is mounted on the center axis of cylindrical container 1, and a plurality of blades 5*a*, 5*b*, 5*c* are mounted on said driving shaft 4. Each of these blades comprises a pair of radial side plates 6, 6' and a kneading blade 7 extending between the ends of side plates 6, 6' remote from driving shaft 4. As shown in FIG. 4, the leading surface of the kneading blade extends both inwardly and forwardly with reference to the direction of rotation depicted by the arrow, such that there is provided a space tapered at a roll-in angle $\alpha$ between the leading surface and the cylindrical container wall on the forward side of the kneading blade. The pair of side plates 6, 6' are formed, as shown in FIG. 6, with an axial feed angle $\beta$ for the material to be treated. In the batch-type machine, the side plates converge toward the leading edge of kneading blade 7, so that on rotation of the blade, the side plates cause inward axial movement of material. The ends of side plates 6, 6' and an end surface of the kneading blade 7 are formed into a circular surface which, with the inner peripheral surfaces of inner cylinder 1*b* forms a kneading gap $\delta$.

Figure 1:
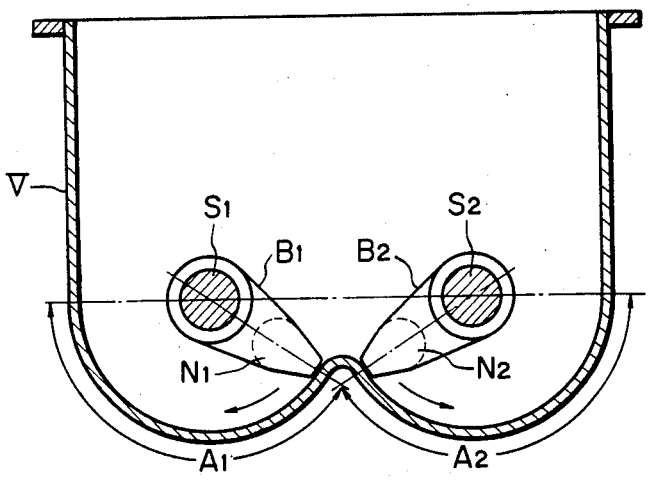
FIG. 1 PRIOR ART
FIG. 1 is a sectional view of a conventional kneading machine taken on a plane to which the operating shafts are perpendicular.

In operation, the discharge opening 3 is closed by a cover, and a quantity of material to be treated is thrown through the supply opening 2. Opening 2 is then closed by a cover or the like, and driving shaft 4 is rotated. Then, the material to be treated is kneaded at the kneading gap $\delta$. The kneading area is remarkably large in comparison to the kneading area of the conventional apparatus of FIG. 1, because, except at the locations of the supply and discharge openings, the kneading area extends over the entire circumference of the inner wall of the cylinder. Even at the locations of the supply and discharge openings, kneading takes place over a major portion of the angular rotation of the blades. This results in a very significant improvement in kneading efficiency over that achievable with the conventional apparatus. In addition, the material to be treated in the vicinity of the inner walls of the inner cylinder is, due to the roll-in angle $\alpha$, rolled in toward the axis and reversed to produce a radial convection. Also, axially reciprocating movement is created in the material to be treated due to the feed angle $\beta$ of the pair of side plates. This axially reciprocating movement produces uniformity in kneading.

When the material is sufficiently kneaded that it can be subjected to further treatment, it is removed batchwise by removing a cover of the discharge opening 3 (FIG. 2 ).

Figure 7:
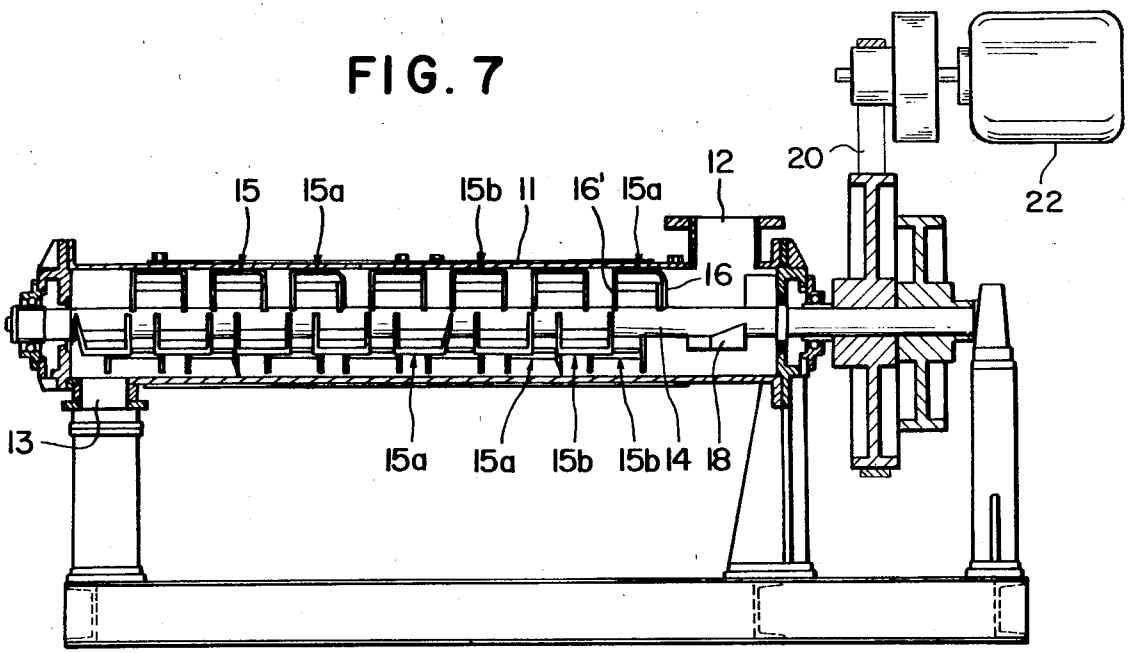
FIG. 7 is a schematic axial section of a continuous kneading machine.
Figure 8:
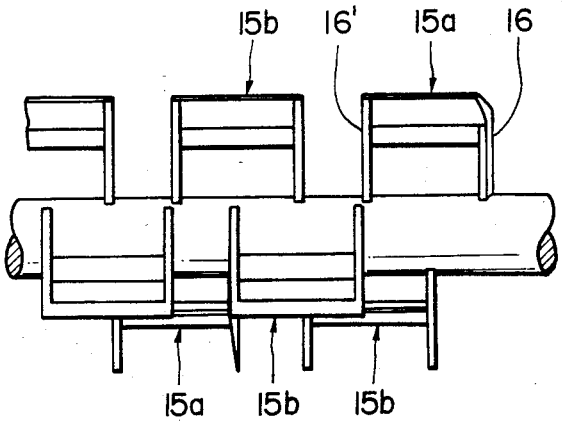
FIG. 8 is an enlarged fragmentary elevational view of essential parts of the machine of FIG. 7 showing the arrangement of blades.

FIGS. 7 and 8 show a continuous kneading machine according to a second embodiment of the present invention. An elongated cylindrical container 11, laterally installed on a support bed, is provided with a supply opening 12 for introduction of a material to be treated and a discharge opening 13, a rotational driving shaft 14 is mounted on a cylindrical center axis of the container, and a number of blades 15 are radially mounted on the driving shaft 14. The shaft is driven in a predetermined direction through belt 20 by drive motor 22. Blades 15 are of two types. Blades 15*a*, each have one side plate 16 disposed at a feed angle $\beta$ and an opposite side plate 16' disposed at a zero feed angle, i.e. perpendicular to the driving shaft axis. Feed angle $\beta$ effects a gradual movement of material toward discharge opening 13. The side plates of blades 15*b* are all disposed at zero feed angles. The different types of blades are scattered in a suitable pattern. For example, as shown in FIG. 7, in each axially extending row of blades, every fourth blade is of the kind having an angled side wall. The blades with angled side walls in each axially extending row are axially displaced with respect to the corresponding blades in the adjacent rows.

Figure 9:
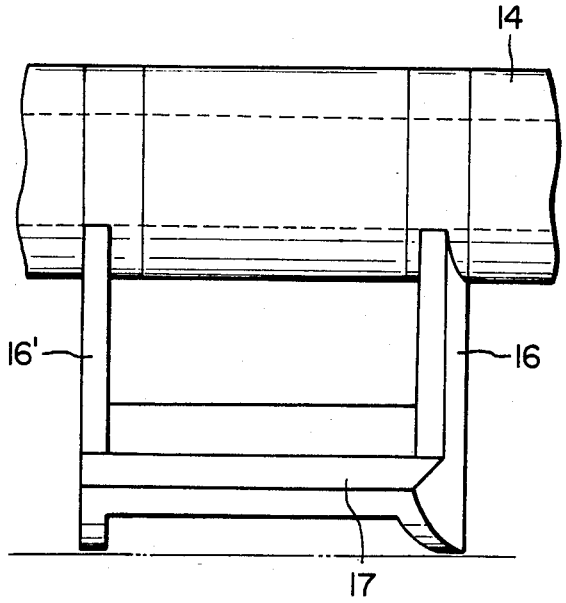
FIG. 9 is an enlarged fragmentary view, through a plane parallel to the axis of rotation, showing essential parts of a kneading blade of a continuous kneading machine, with a side plate having a feed angle.
Figure 10:
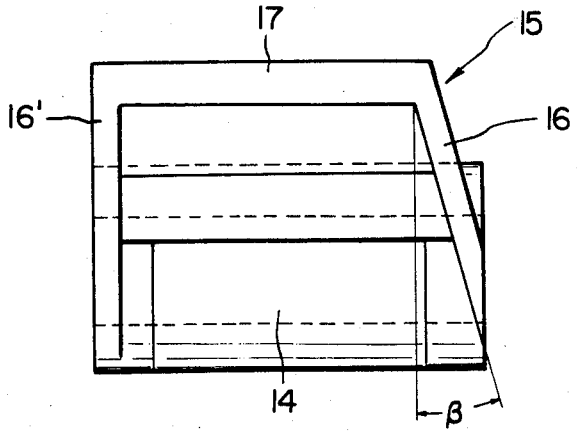
FIG. 10 is a bottom view of the blade of the FIG. 9.

FIGS. 9 and 10 are enlarged views of a blade 15*a*. Side plate 16 is formed with a feed angle $\beta$, and side plate 16' is perpendicular to the axis of the rotational driving shaft 14, i.e., its feed angle is zero. The kneading blade 17, extending between the side plates is formed with a roll-in angle similar to the roll-in angle of kneading blade 7 in the embodiment of FIGS. 2–6. All of the kneading blades of FIGS. 7 and 8 are formed with roll-in angles.

In operation of the kneading machine of FIGS. 7–10, material to be treated is continuously thrown through supply opening 12 and fed in a direction of the blades by a feed blade 18 mounted on the rotational driving shaft directly below the supply opening. The material is kneaded within the gaps between the inner peripheral walls of the cylindrical container 11 and the kneading blades, and is uniformly inverted and kneaded by the kneading blades and fed toward the discharge opening 13 due to the feed angle $\beta$ of the angled side plates of blades 15*a*. Since the feed speed is reduced due to the resistance imposed on the flow of material by the aforementioned side plate with zero feed angle, the numbers and arrangement of blades 15*a* and 15*b* can be varied to effect an increase or decrease in feed speed of the material to be treated. Accordingly, the kneading time may be adjusted. The blades are splined or keyed to the driving shaft, and are individually removable therefrom so that the arrangement and number of the different types of blades can be varied.

As described above, in the present invention, the kneading operation of the material to be treated is performed throughout substantially the entire 360 degrees of rotation of the blade. Therefore, the kneading efficiency is remarkably enhanced as compared with the conventional apparatus. Thus, even if the rotational driving shaft comprises a single shaft, the machine can be made small in size. Moreover, since the material to be treated is inverted and kneaded due to the roll-in angle formed in the kneading blade, kneading is efficiently carried out. In a batch-type kneading machine, the feed angle of the side plates effects axial reciprocation of material being treated for more efficient and thorough kneading. Continuous kneading operation is made possible by providing certain blades with angled side plates to effect gradual axial feed of material. Furthermore, the number and arrangement of these blades with angled side plates may be suitably selected to render possible an increase or decrease in kneading time of the material to be treated, thus offering a remarkable improvement.

We claim:

1. A kneading machine comprising a container having a cylindrical wall and having a supply opening and a discharge opening in said cylindrical wall for a material to be treated, a rotational driving shaft positioned on a center axis of said cylindrical wall, means for rotating said driving shaft in a predetermined direction of rotation, and a plurality of radial blades mounted on said shaft, each of said blades comprising a pair of radial side plates and a kneading blade extending between the ends of said side plates remote from the shaft, each kneading blade having an outer end positioned at a radial location such as to provide a kneading gap between said outer end and the cylindrical container wall, and having a leading surface extending both inwardly from said outer end, and forwardly therefrom with reference to said direction of rotation, at an angle such as to provide a tapered space between said leading surface and the cylindrical container wall on the forward side of said kneading blade.

2. A kneading machine according to claim 1 in which at least one of said pair of side plates of at least one of said radial blades is formed with an axial feed angle for the material to be treated.

3. A kneading machine according to claim 1 in which said supply opening is axially displaced from said discharge opening, and in which at least one of the side plates of at least one of said radial blades is formed with an axial feed angle to effect movement of material from the supply opening toward the discharge opening as the driving shaft rotates in said predetermined direction.

4. A kneading machine according to claim 1 in which the outer end of each kneading blade is in the form of a circular cylindrical surface.

5. A kneading machine according to claim 1 in which the outer ends of the side plates of each of said radial blades, and the outer end of the kneading blade thereof, are formed into a common circular cylindrical surface.

6. A kneading machine according to claim 5 in which at least one of said pair of side plates of at least one of said radial blades is formed with an axial feed angle for the material to be treated.

7. A kneading machine according to claim 5 in which said supply opening is axially displaced from said discharge opening, and in which at least one of the side plates of at least one of said radial blades is formed with an axial feed angle to effect movement of material from the supply opening toward the discharge opening as the driving shaft rotates in said predetermined direction.

* * * * *